US006386187B1

(12) United States Patent
Phykitt

(10) Patent No.: US 6,386,187 B1
(45) Date of Patent: May 14, 2002

(54) DEVICE AND PROCESS FOR IMPROVING FUEL CONSUMPTION AND REDUCING EMISSIONS UPON FUEL COMBUSTION

(75) Inventor: Howard P. Phykitt, Vernon, NJ (US)

(73) Assignee: Performance Fuel Systems LLC, Rye, NY (US)

( * ) Notice: Subject to any disclaimer, the term of this patent is extended or adjusted under 35 U.S.C. 154(b) by 0 days.

(21) Appl. No.: 09/680,717

(22) Filed: Oct. 6, 2000

Related U.S. Application Data

(63) Continuation-in-part of application No. 09/556,560, filed on Apr. 24, 2000.

(51) Int. Cl.[7] ..... F02M 27/04
(52) U.S. Cl. ..... 123/538
(58) Field of Search ..... 123/538, 537, 123/536; 210/222, 695

(56) References Cited

U.S. PATENT DOCUMENTS 5,356,534 A * 10/1994 Zimmerman et al. ..... 210/222
5,738,692 A * 4/1998 Wright ..... 123/538
5,816,226 A * 10/1998 Jernigan et al. ..... 123/538
6,024,073 A * 2/2000 Butt ..... 123/538

* cited by examiner

*Primary Examiner*—Marguerite McMahon
(74) *Attorney, Agent, or Firm*—Ohlandt, Greeley, Ruggiero & Perle, LLP; George W. Rauchfuss, Jr.

(57) ABSTRACT

A device and process is provided for treatment of a hydrocarbon or fossil fuel which is to be combusted in a combustion chamber to improve combustion of the fuel in the combustion chamber by turbulently treating the fuel with a plurality of fields of magnetic flux and subjecting the fuel to a field of differing standard electrochemical reduction potentials. The device is adapted to be connected in-line in a fuel supply line of the combustion chamber and comprises:

a non-magnetic, elongate hollow tubular housing having a longitudinal axis, opposing inlet and outlet ends, a generally centrally located inlet aperture in said inlet end for receiving fuel and a generally centrally located outlet aperture in said outlet end for dispensing treated fuel;

a plurality of longitudinally elongated magnets located in the housing on opposing sides of the longitudinal axis providing a series of differing or alternating fields of magnetic flux along the longitudinal axis and providing opposing, facing pole faces of the magnets for contact with the fuel; and optionally, but preferably, at least two large surface area non-ferrous metal wool or screen materials of differing standard electrochemical reduction potentials in the housing, the metals being located along the longitudinal axis of the housing and between the magnets of the plurality of magnets and establishing a field of standard electrochemical reduction potential differential in the housing through which the fuel must flow.

The device may also comprise axially spaced, radially extending, apertured flow controllers for directly turbulent flow of fuel through the screen materials and the series of alternating field of magnetic flux.

36 Claims, 3 Drawing Sheets

DEVICE AND PROCESS FOR IMPROVING FUEL CONSUMPTION AND REDUCING EMISSIONS UPON FUEL COMBUSTION

RELATED APPLICATION

This application is a continuation-in-part of my copending application No 09/556,560 filing date Apr. 24, 2000.

FIELD OF THE INVENTION

This invention relates to a device and a process for treating liquid hydrocarbon or fossil fuel to improve the combustion characteristics of the fuel and thereby improve fuel consumption, reduce exhaust gas temperatures from the combustion chamber, and reduce the production of pollutants upon combustion of the fuel. More particularly, this invention relates to a device for use in-line to treat a liquid hydrocarbon or fossil fuel before the fuel enters the combustion chamber of an engine or other fuel fired apparatus in order to enhance or improve the combustion of the fuel so that the combusted fuel produces less pollutants, exhaust gas exits the combustion chamber at a reduced temperature, and improved fuel efficiency is obtained so that in vehicular engines the miles per gallon is significantly improved.

BACKGROUND OF THE INVENTION

It is well known to treat hydrocarbon or fossil fuels to improve combustion efficiency and to reduce the production of harmful emissions or pollutants. Various chemical additives have been suggested to produce more efficient combustion of the fuel to decrease harmful emissions, and numerous magnetic type devices have been proposed to improve fuel efficiency in motor vehicles.

Among the many chemical additives suggested for addition to hydrocarbon or fossil fuel as oxygenators to improve the combustion of fuel are ethanol and methyl tert-butyl ether (MTBE). Ethanol has proved to be too expensive and not readily available. Therefore, the US Congress has mandated that certain amounts of MTBE be included in gasoline to lower harmful emissions. While MTBE has been found to be beneficial in this respect, its use has now been brought under question due to the possible carcinogenic effects from MTBE and its use causing contamination of underground water supplies. Thus, there is a need for a means to improve the combustion of hydrocarbon or fossil fuel without the need for such undesirable chemical additives that have heretofore been proposed.

Numerous devices have been proposed to increase the fuel efficiency of fuels used in motor vehicles. A large number of these devices involve the use of magnets and magnetic fields. Devices that employ magnets both outside and inside the fuel line have been proposed. As examples of such devices are those disclosed in the following U.S. Pat. Nos. 4,254,393; 4,289,621; 4,372,852; 4,572,145; 4,933,151; 5,271,369; 5,305,725; 5,411,143; 5,520,158; 5,558,765; 5,816,221; and 5,840,184.

However, despite the multitude of such devices proposed, devices of this type have not been widely adopted by either the automotive industry as original equipment or by the public as after-market equipment. Generally, this has been the case because the devices produce only marginal improvement in fuel efficiency or fail to significantly reduce any harmful combustion emissions.

It is therefore an object of the present invention to provide a device for treating a liquid hydrocarbon or fossil fuel which avoids the drawbacks and deficiencies of the chemical additives of the heretofore proposed devices. A further object of this invention is to provide a device for installation in-line in a fuel supply line to treat the hydrocarbon or fossil fuel prior to the entrance of the fuel into a combustion chamber and which devices will improve the combustion of the fuel to provide both increased fuel efficiency, reduced combustion chamber exhaust gas temperatures and reduced production of harmful pollutants as emissions from the combustion process. A still further object of this invention is to provide such a device particularly suitable for use in-line in motor vehicles.

BRIEF SUMMARY OF THE INVENTION

This invention provides a device and a process for treating a hydrocarbon or fossil fuel which is to be combusted in a combustion chamber wherein the fuel is treated with a plurality of fields of differing or alternating magnetic flux, subjected to a field of differing standard electrochemical reduction potentials and subjected to mechanical forces causing the fuel to be turbulently treated in the device and process.

More particularly, the invention provides a device and process for treating such a fuel whereby the fuel is subjected toga residence time exposure to the fields of differing or alternating magnetic flux of at least 0.5 seconds, and also wherein at least 50 square inches of opposing, facing pole faces of magnets are provided for contacting the fuel. In a further embodiment of the invention, the device of this invention provides for the fuel to pass through a field of at least two non-ferrous metal materials of differing standard electrochemical reduction potential simultaneously with passage of the fuel through the plurality of fields of magnetic flux.

In another embodiment of the device and process of this invention, the device is provided with flow controllers causing essentially all the fuel to simultaneously flow through the plurality of fields of magnetic flux and through the field of standard electrochemical reduction potential differential in a turbulent flow pattern.

A device of this invention is provided for treatment of a hydrocarbon or fossil fuel which is to be combusted in a combustion chamber to improve combustion of the fuel in the combustion chamber by turbulently treating the fuel with a plurality of fields of differing or alternating magnetic flux and subjecting the fuel to a field of differing standard electrochemical reduction potentials. Such a device is adapted to be connected in-line in a fuel supply line of the combustion chamber and comprises:

- a non-magnetic, elongate hollow tubular housing having a longitudinal axis, opposing inlet and outlet ends, a generally centrally located inlet aperture in said inlet end for receiving fuel and a generally centrally located outlet aperture in said outlet end for dispensing treated fuel;
- a plurality of longitudinally elongated magnets located in the housing on opposing sides of the longitudinal axis providing a series of differing or alternating fields of magnetic flux along the longitudinal axis; and
- optionally, but preferably, at least two large surface area non-ferrous metal wool or screen materials of differing standard electrochemical reduction potentials in the housing, the metals being located along the longitudinal axis of the housing and between the magnets of the plurality of magnets and establishing a field of standard electrochemical reduction potential differential in the housing through which the fuel must flow.

In one embodiment, the device of this invention comprises:

a non-magnetic, elongate hollow tubular housing having a longitudinal axis, opposing inlet and outlet ends, a generally centrally located inlet aperture in the inlet end for receiving fuel and a generally centrally located outlet aperture in the outlet end for dispensing treated fuel;

a longitudinally extending first plurality of magnets located inside the housing and parallel to a first side of the longitudinal axis, a longitudinally extending second plurality of magnets located inside the housing and parallel to and latitudinally spaced apart from the first set of magnets and located on a second and opposite side of the longitudinal axis, each magnet of said first and second plurality of magnets having a longitudinal pole face facing the longitudinal axis and each having a magnetic polarity, the magnetic polarity of the longitudinal pole face of each magnet of the first plurality of magnets being of a magnetic polarity opposite the magnetic polarity of the longitudinal pole face of an opposing facing magnet of the second plurality of magnets, and the magnetic polarity of the longitudinal pole face of each magnet of the first and second plurality of magnets being of different magnetic polarity to the magnetic polarity of adjacent magnets in the respective first and second longitudinal plurality of magnets; and optionally, but preferably, at least two large surface area non-ferrous metal wool or screen materials of differing standard electrochemical reduction potentials extending longitudinally along the axis of the housing and between the spaced apart first and second plurality of magnets establishing a field of standard electrochemical reduction potential differential in said housing through which fuel must flow.

In another embodiment of this invention the device comprises:

a non-magnetic, elongate hollow tubular housing having a longitudinal axis, opposing inlet and outlet ends, a generally centrally located inlet aperture in the inlet end for receiving fuel and a generally centrally located outlet aperture in the outlet end for dispensing treated fuel;

a longitudinally extending first plurality of magnets located inside the housing and parallel to a first side of the longitudinal axis, a longitudinally extending second plurality of magnets located inside the housing and parallel to and latitudinally spaced apart from the first set of magnets and located on a second and opposite side of the longitudinal axis, each magnet of said first and second plurality of magnets having a longitudinal pole face having a magnetic polarity, the magnetic polarity of the longitudinal pole face of each magnet of the first plurality of magnets being of the same magnetic polarity as the magnetic polarity of the longitudinal pole face of an opposing facing magnet of the second plurality of magnets, and the magnetic polarity of the longitudinal pole face of each magnet of the first and second plurality of magnets being of different magnetic polarity to the magnetic polarity of adjacent magnets in the respective first and second longitudinal plurality of magnets; and optionally, but preferably, at least two large surface area non-ferrous metal wool or screen materials of differing standard electrochemical reduction potentials extending longitudinally along the axis of the housing and between the spaced apart first and second plurality of magnets establishing a field of standard electrochemical reduction potential differential in said housing through which fuel must flow.

The elongate hollow tubular housing of the device is of any suitable shape, such as cylindrical or rectangular in shape.

A device of this invention may additionally comprise a first elongate longitudinal strip of ferromagmetic material, such as carbon steel, overlaying the first plurality of magnets between the first plurality of magnets and an adjacent wall of the tubular housing, and a second elongate longitudinal strip of carbon steel overlaying the second plurality of magnets between the second plurality of magnets and the adjacent wall of the tubular housing. The presence of these elongated strips of carbon steel appears to intensify the fields of magnetic flux between the pluralities of magnets.

In the device according to the invention, the large surface area non-ferrous metal wool or screen materials preferably comprise alternating layers of two different metals, particularly two different metal screens of differing electrochemical reduction potentials. Although any suitable non-ferrous metals may be employed, it is preferred that one metal be of a positive reduction potential and one of a negative reduction potential. It is generally preferred that the alternating layers of two different metal screens comprise alternating layers of copper and aluminum screens.

A device according to this invention is preferably sized and shaped so the first and second plurality of magnets provide a series of differing or alternating fields of magnetic flux along the longitudinal axis of the housing so that at least 50 square inches of opposing, facing pole faces of the magnets are provided along the longitudinal axis for contact with the fuel, and to provide at least 0.5 seconds of residence time exposure of the fuel to the opposing magnetic pole faces of the magnets providing the series of alternating fields of magnetic flux along the longitudinal axis.

A device according to this invention may be provided, if desirable or necessary, with a plurality of axially spaced, radially extending flow controllers, each controller having a central aperture located essentially along the longitudinal axis of the housing for causing fuel flowing through the housing to flow through the central apertures of the flow controllers whereby fuel generally is caused to flow between the facing longitudinal pole faces of the opposing magnets of the first and second plurality of magnets and generally along the longitudinal axis of the housing. The magnets employed in the device will preferably comprise magnets of a strength of at least 3800 gauss per magnet and are preferably cermet magnets.

In certain embodiments of the device according to this invention, each of the first and second plurality of magnets comprise adjacent longitudinally parallel first and second rows of magnets, preferably at least five magnets per row, the magnets of the adjacent longitudinally parallel first and second rows of each plurality of magnets being arranged such that the magnetic polarity of the magnetic pole face of each of the magnets along the longitudinal axis in the first row is of opposite polarity from the magnetic polarity of the magnetic pole face of each opposite magnet along the longitudinal axis in the second row.

In other embodiments of the device of this invention, each of the magnets of the adjacent longitudinally parallel first and second rows of magnets is arranged such that the magnetic polarity of the magnetic pole face of each of the magnets along the longitudinal axis in the first row is of the same magnetic polarity as the magnetic polarity of the facing magnetic pole face of each of the opposing magnets along the longitudinal axis in the second row of magnets, and the magnetic polarity of the magnets being of different or alternate polarity with the polarity of adjacent magnets of the respective first and second longitudinal plurality of magnets.

A device according to this invention may have a porous filter, preferably a bronze filter, in the tubular housing adjacent the outlet aperture through which the fuel must flow to exit the device for removal of particulate impurities from the fuel.

A device of this invention is provided for treatment of a hydrocarbon or fossil fuel which is to be combusted in a combustion chamber to improve combustion of the fuel in the combustion chamber by turbulently treating the fuel with a plurality of fields of magnetic flux and subjecting the fuel to a field of differing standard electrochemical reduction potentials. Such a device is adapted to be connected in-line in a fuel supply line of the combustion chamber, particularly a fuel supply line of a vehicle engine. Such a device comprises:

a non-magnetic, elongate hollow tubular housing having a longitudinal axis, opposing inlet and outlet ends, a generally centrally located inlet aperture in said inlet end for receiving fuel and a generally centrally located outlet aperture in said outlet end for dispensing treated fuel;

a plurality of longitudinally elongated magnets located in the housing on opposing sides of the longitudinal axis providing a series of differing or alternating fields of magnetic flux along the longitudinal axis and preferably providing at least 50 square inches of opposing, facing pole faces of the magnets for contact with the fuel; and at least two large surface area non-ferrous metal wool or screen materials of differing electrochemical reduction potentials in the housing, the metals being located along the longitudinal axis of the housing and between the magnets of the plurality of magnets and establishing a field of standard electrochemical reduction potential differential in the housing through which the fuel must flow.

Such a device may additionally comprise a plurality of centrally apertured, axially spaced flow control means in the housing which cause fuel to flow centrally through the flow control means, generally along the longitudinal axis, between opposing facing pole faces of the magnets and through the two large surface area non-ferrous metals.

The process of this invention for treatment of a hydrocarbon or fossil fuel substantially immediately prior to introducing the fuel into a combustion chamber to improve the combustion of the fuel in the combustion chamber comprises passing the hydrocarbon or fossil fuel into a non-magnetic elongated hollow tubular housing and turbulently passing the fuel:

(a) through a series of strong differing or alternating magnetic flux fields created by first and second longitudinal pluralities of spaced-apart opposing magnets along a opposite sides of a longitudinal axis within the housing, the magnets being oriented so that opposing longitudinal pole faces of the magnets of the first and second plurality of magnets along the longitudinal axis provide a series of differing or alternating fields of magnetic flux; and (b) into contact with at least two large surface area non-ferrous metal wool or screen materials of differing standard electrochemical reduction potentials and located between the first and second pluralities of magnets;

whereby the fuel is subjected to alternating magnetic flux fields, a field of standard electrochemical reduction differential and mechanical forces.

The process optionally provides for the fuel to pass through fuel flow control means requiring generally centralized flow of fuel along a centrally located longitudinal axis of the housing between and in the magnetic flux fields between the opposing longitudinal pole faces of the opposing magnets of the first and second pluralities of magnets.

A process is also provided for treatment of a hydrocarbon or fossil fuel substantially immediately prior to introducing the fuel into a combustion chamber to break up negatively charged molecule clusters of the fuel and to produce positively charged hydrocarbon units to improve combustion of the fuel. This process comprises passing the fuel into a non-magnetic elongated tubular housing having a longitudinal axis, an inlet at a first end, and an outlet at a second and opposite end of the longitudinal axis, and turbulently passing the fuel through the tubular housing in a manner such that the fuel is caused to:

(1) pass through a series of differing or alternating fields of magnetic flux located along the longitudinal axis of the housing such that the fuel is exposed to at least 50 square inches of opposing, facing magnetic pole faces of magnets providing said series of alternating fields of magnetic flux; and (2) contact and pass through at least two large surface area non-ferrous metal wool or screen materials of differing standard electrochemical reduction potentials in the housing;

whereby said fuel has at least 0.5 seconds of residence time of exposure to the magnetic pole faces of the magnets along the longitudinal axis providing the series of differing or alternating fields of magnetic flux and to the two large surface area non-ferrous metal materials.

In one embodiment of the process of this invention the process provides, for treatment of a hydrocarbon or fossil fuel substantially immediately prior to introducing the fuel into a combustion chamber to improve the combustion of the fuel in the combustion chamber comprises passing the hydrocarbon or fossil fuel into a non-magnetic elongated hollow tubular housing and turbulently passing the fuel:

(a) through a series of strong magnetic flux fields created by first and second longitudinal pluralities of spaced-apart opposing magnets within the housing, the magnets being oriented so that opposing longitudinal pole faces of the magnets of the first and second plurality of magnets are of opposing magnetic polarity and the magnetic polarity of the longitudinal pole faces of each magnet in the first and second plurality of magnets being of opposite magnetic polarity from the magnetic polarity of adjacent magnets in the respective first and second plurality of magnets, and (b) into contact with at least two large surface area non-ferrous metal wool or screen materials of differing standard electrochemical reduction potentials and located between the first and second pluralities of magnets;

whereby the fuel is subjected to differing or alternating magnetic flux fields, a field of standard electrochemical reduction differential and mechanical forces.

The embodiment of the process of this invention optionally provides for the fuel to pass through fuel flow control means requiring generally centralized flow of fuel along a centrally located longitudinal axis of the housing between and in the magnetic flux fields between the opposing longitudinal pole faces of the opposing magnets of the first and second pluralities of magnets.

A process is also provided for treatment of a hydrocarbon or fossil fuel substantially immediately prior to introducing the fuel into a combustion chamber to break up negatively charged molecule clusters of the fuel and to produce positively charged hydrocarbon units to improve combustion of the fuel. This process comprising passing the fuel into a non-magnetic elongated tubular housing having a longitudinal axis, an inlet at a first end, and an outlet at a second and opposite end of the longitudinal axis, and turbulently passing the fuel through the tubular housing in a manner such that the fuel is caused to:

(3) pass through differing or alternating fields of magnetic flux located along the longitudinal axis of the housing such that the fuel is exposed to at least 50 square inches of opposing, facing magnetic pole faces of magnets providing said series of differing or alternating fields of magnetic flux; and (4) contact and pass through at least two large surface area non-ferrous metal wool or screen materials of differing standard electrochemical reduction potentials in the housing;

whereby said fuel has at least 0.5 seconds of residence time of exposure to the opposing magnetic pole faces of the magnets providing the series of differing or alternating fields of magnetic flux and to the two large surface area non-ferrous metal materials.

This embodiment of the process of this invention can optionally provide for the fuel to contact a plurality of centrally apertured spaced flow control means in the housing which cause the fuel to flow centrally through the flow control means and generally along the longitudinal axis and between the opposing magnetic pole faces of the magnets.

The devices and processes of this invention may have present any combination of the various features described hereinbefore or hereinafter.

BRIEF DESCRIPTION OF THE DRAWINGS

The invention is illustrated, but not limited, by the attached drawings in which.

DETAILED DESCRIPTION OF THE INVENTION AND PREFERRED EMBODIMENTS

Figure 1:
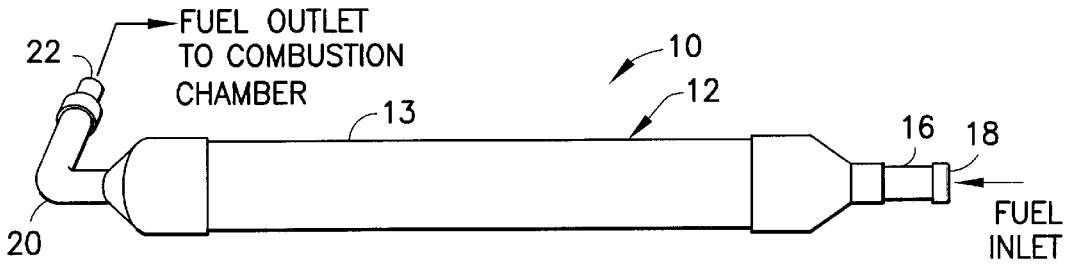
FIG. 1 is a perspective view of a device of this invention.
Figure 2:
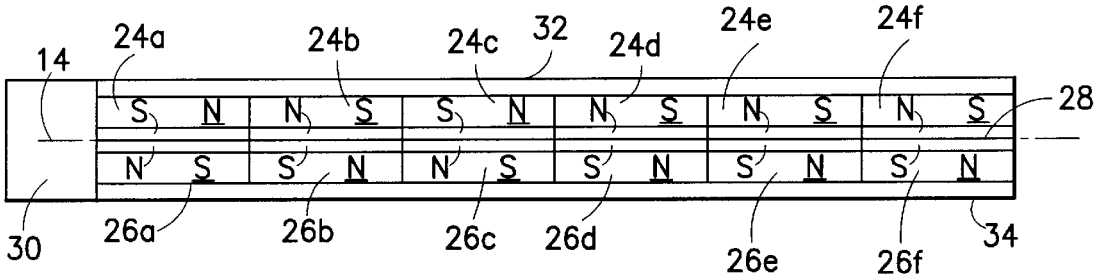
FIG. 2 is a perspective view of a device of FIG. 1 with the outer housing removed to show the internal elements of the device.

Referring to FIGS. 1 and 2, a device of this invention for the treatment of hydrocarbon or fossil fuel to improve the combustion of the fuel which is to be combusted in a combustion chamber is illustrated. The device 10 comprises a non-magnetic, elongated hollow tubular housing 12 having an outer wall surface 13 and a longitudinal axis 14. At a first inlet end 16 of the device 10, a generally centrally located inlet aperture 18 is located for receiving a fuel to be treated by the device. At the opposite outlet end 20 of the device 10, a generally centrally located outlet aperture 22 is provided for dispensing, to a combustion chamber (not shown), the fuel treated in the device.

Located in the device housing 12 on a first side of the longitudinal axis 14 is a longitudinally extending first plurality of magnets 24*a* through 24*f*. A second set of longitudinally extending plurality of magnets 26*a* through 26*f* is located on a second and opposite side of the longitudinal axis 14 and parallel to, but spaced apart from, the first plurality of magnets. Each magnet of the first and second plurality of magnets 24*a* through 24*f* and 26*a* through 26*f* has a longitudinal magnetic pole face having a magnetic polarity N or S such that the magnetic polarity of the longitudinal pole face of each magnet of the first plurality of magnets 24*a* through 24*f* is of a magnetic polarity opposite the magnetic polarity of the longitudinal pole face of a respective opposing magnet of the second plurality of magnets 26*a* through 26*f*. Additionally, the longitudinal pole face of each magnet of the first and second plurality of magnets is of opposite polarity with an adjacent magnet in the respective first and second longitudinal plurality of magnets. This arrangement establishes a plurality of fields of differing or alternating magnetic flux through which the fuel is caused to flow. The magnets may be of any suitable type, but are preferably cermet magnets having a strength of at least 3800 gauss per magnet.

In the space along the longitudinal axis 14 between the first and second plurality of magnets there is provided at least two non-ferrous metal materials 28 providing large surface areas, such as for example, metal screens or wools, that are of differing standard electrochemical reduction potential to establish a field of standard electrochemical reduction potential differential through which the fuel is caused to flow. While the non-ferrous metals can be any suitable metals of differing electrochemical reduction potential, it is preferred that one metal have a positive reduction potential and the other a negative reduction potential. The metals are preferably screens of copper and aluminum or zinc and are more preferably alternating layers of copper and aluminum screens. The screens also advantageously act to provide turbulence to the flow of fuel through the device.

The opposing sets of plurality of magnets are set as close as possible to each other on the opposite sides of the longitudinal axis with the large surface area non-ferrous metal materials filling the space between the rows of magnets. The space between the rows is preferably about ¼ inch. The device is so constructed as to produce a significant amount of turbulence in the flow of the fuel through the device.

Optionally, the device is provided with a porous filter element 30 adjacent the outlet end 20. A preferably porous filter is a porous bronze filter which contributes to the establishment of a field of standard electrochemical reduction potential differential. However, a porous filter of any suitable material may be employed to trap foreign material in the fuel, such as foreign materials that may break away from the magnets or large surface area materials.

The device is also optionally, but preferably, provided with an elongated longitudinal strip of carbon steel 32 and 34 overlaying each plurality of magnets 24*a* through 24*f* and 26*a* through 26*f* between the magnets and adjacent wall 13 of the tubular housing 12. The presence of these strips of steel 32 and 34 appears to intensify the fields of magnetic flux through which the fuel is caused to flow.

While the pluralities of magnets exemplified in the device of FIGS. 1 and 2 comprise six such magnets in each plurality, the number of magnets in the pluralities may vary depending on the volume of fuel to be treated. Each plurality will comprise at least two magnets and preferably at least five or more magnets. For a device of this invention intended to treat fuel in the fuel line of an automobile or truck engine, each plurality of magnets will comprise at least five magnets. For a device intended to treat fuel in the fuel line of a motorcycle engine, each plurality of magnets will comprise at least two magnets.

The number and of size of the magnets is preferably such as to provide a series of differing or alternating fields of magnetic flux along the longitudinal axis of the device so as to provide at least 50 square inches of opposing, facing pole faces of the magnets along the longitudinal axis for contact with the fuel to be treated in an automobile. In a device intended to treat fuel in the fuel line of a motorcycle, the number and size of the magnets is such as to provide at least 10 square inches of such opposing, facing pole faces.

The device is also sized and shaped so as to preferably provide at least 0.5 seconds, more preferably at least 3 seconds, and even more preferably at least 5 seconds, of residence time exposure of the fuel to the opposing magnetic pole faces of the magnets providing the series of differing or alternating fields of magnetic flux along the longitudinal axis of the device.

Figure 3:
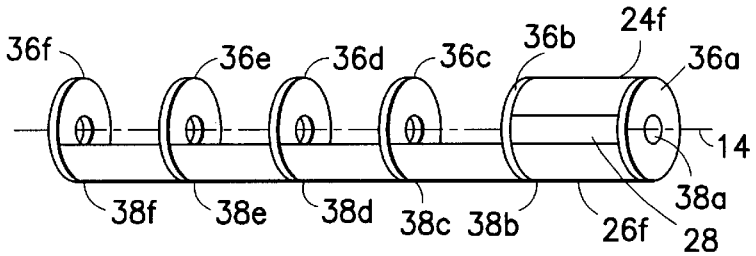
FIG. 3 is a perspective view of another device of FIG. 1 with the outer housing removed to show the internal elements of another embodiment of the device of FIG. 1, with a portion of the internal elements removed for clarity of illustration.

Another embodiment of a device of this invention is illustrated in FIG. 3. For purposes of more clearly illustrating the invention, some of the magnets in the first plurality of magnets have been removed. In this embodiment, the device is provided with a plurality of axially spaced, radially extending flow controller means 36*a* through 36*f*, preferably spaced between each magnet of the pluralities of magnets. The flow controllers 36*a* through 36*f*, which may be in any suitable shape or design, are preferably the form of washer-type disks with ¼" apertures, are each provided with a centrally located aperture 38*a* through 38*f* for causing fuel flowing through the housing to flow through these centrally located apertures whereby fuel generally is caused to flow between the facing longitudinal pole faces of the opposing magnets of the first and second plurality of magnets, through the non-ferrous metal screen materials 28 and generally along the longitudinal axis 14 of the housing 12.

While the housing in FIGS. 1 through 3 is shown to be a cylindrical housing, the housing may be of any suitable shape. In the embodiment shown in FIG. 4, the device 210 has a rectangular shaped housing 212. The housing 212 is provided at its inlet end 216 with an end plate 217 having a central aperture 218 for entry of fuel into the device 210. The outlet end 220 is similarly provided with an end plate having a central aperture (not shown) for dispensing treated fuel. While the housing 12 of the device can be made of any suitable non-magnetic material, it is preferably copper, brass or bronze, and most preferably a heavy wall copper tube.

Figure 4:
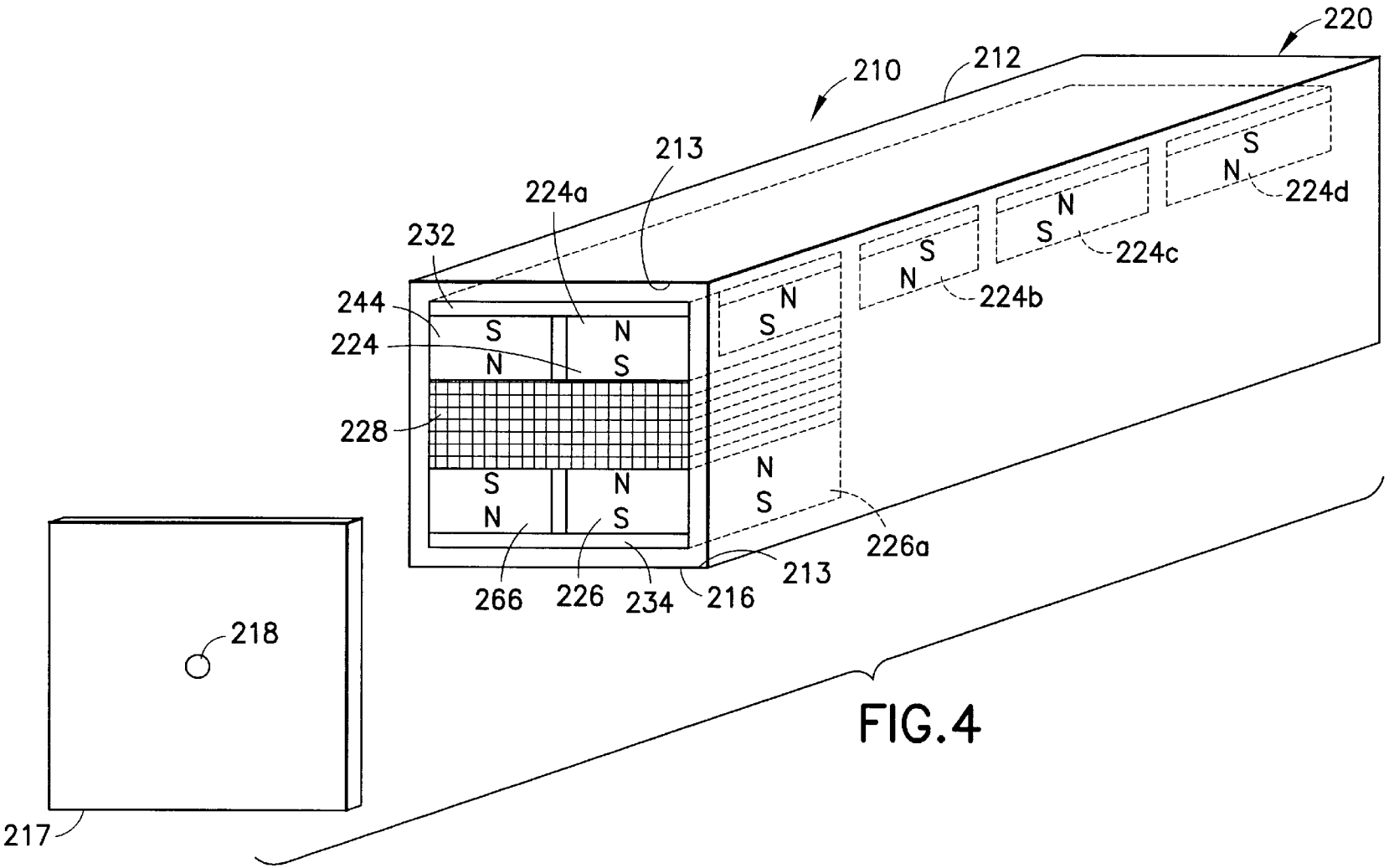
FIG. 4 is an exploded, perspective view, partially in section, of a further device of this invention.

In the embodiment shown in FIG. 4, a further embodiment of the invention is also illustrated. In this embodiment, each of the first and second longitudinally extending plurality of magnets comprises adjacent longitudinally parallel rows of magnets. As shown in FIG. 4, the first plurality of magnets comprises parallel rows 224 and 244 of magnets and the second plurality of magnets comprises parallel rows 226 and 266 of magnets. Each row has a plurality of magnets, for example, row 224 comprises magnets 224*a* through 224*d*. For simplicity purposes, the other magnets are not shown in this Figure. The magnets of the adjacent longitudinal rows are arranged such that the magnetic polarity of the magnetic pole face of each of the magnets in the row is of opposite polarity from the magnetic polarity of the magnetic pole face of each adjacent magnet in the adjacent longitudinal row, i.e., in a checkerboard type arrangement.

As in the other embodiments, at least two large surface area, non-ferrous metal, wool or screen materials 228 are positioned between the first and second longitudinal plurality of magnets. Also, elongated longitudinal strips of carbon steel 232 and 234 overlay both rows 224, 244 and rows 226, 266 of the first and second plurality of magnets adjacent the wall 213 of the housing.

Figure 5:
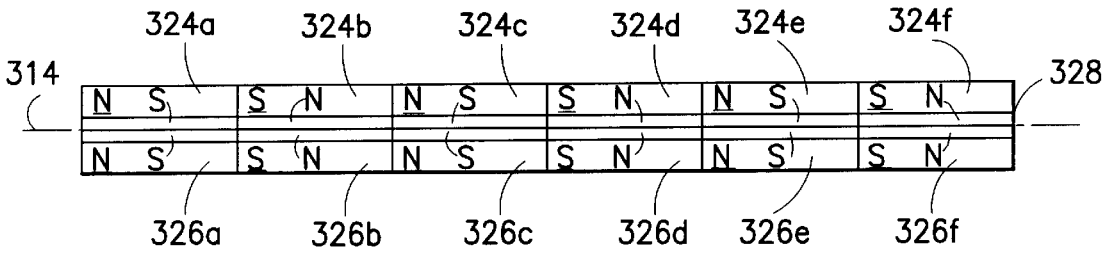
FIG. 5 is a perspective view of another device of FIG. 1 with the outer housing removed to show the internal elements of the device.

FIG. 5 illustrates another embodiment of the device of this invention. FIG. 5, like FIG. 2, illustrates the internal elements of this embodiment of a device of the type shown in FIG. 1. Located in the device housing on a first side of the longitudinal axis 314 is a longitudinally extending first plurality of magnets 324*a* through 324*f*. A second set of longitudinally extending plurality of magnets 326*a* through 326*f* is located on a second and opposite side of the longitudinal axis 314 and parallel to, but spaced apart from, the first plurality of magnets. Each magnet of the first and second plurality of magnets 324*a* through 324*f* and 326*a* through 326*f* has a longitudinal magnetic pole face having a magnetic polarity N or S such that the magnetic polarity of the longitudinal pole face of each magnet of the first plurality of magnets 324*a* through 324*f* is of a magnetic polarity the same as the magnetic polarity of the longitudinal pole face of a respective opposing magnet of the second plurality of magnets 326*a* through 326*f*. Additionally, the longitudinal pole face of each magnet of the first and second plurality of magnets is of opposite polarity to the magnetic polarity of adjacent magnet in the respective first and second longitudinal plurality of magnets. This arrangement establishes a plurality of fields of differing or alternating magnetic flux through which the fuel is caused to flow. The magnets may be of any suitable type, but are preferably cermet magnets having a strength of at least 3800 gauss per magnet.

In the space along the longitudinal axis 314 between the first and second plurality of magnets there is provided at least two non-ferrous metal materials 328 providing large surface areas, such as for example, metal screens or wools, that are of differing standard electrochemical reduction potential to establish a field of standard electrochemical reduction potential differential through which the fuel is caused to flow. While the non-ferrous metals can be any suitable metals of differing electrochemical reduction potential, it is preferred that one metal have a positive reduction potential and the other a negative reduction potential. The metals are preferably screens of copper and aluminum or zinc and are more preferably alternating layers of copper and aluminum screens. The screens also advantageously act to provide turbulence to the flow of fuel through the device.

Figure 6:
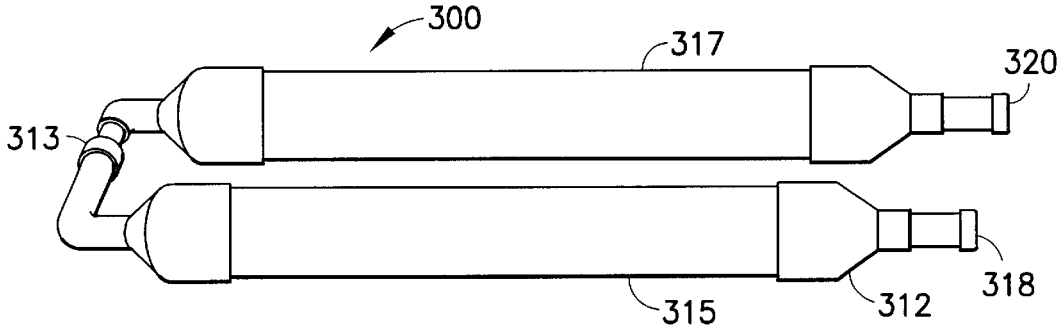
FIG. 6. is a perspective view of another device of this invention illustrating an alternative external construction.

In certain instances, such as for use in fuel lines on tractor trailer or semi-trailer trucks, it may be necessary for the device of this invention to be of considerable length in order to provide the necessary residence time of the fuel in the device. In such instances it may be desirable or necessary to have the device require less longitudinal length in order to conveniently fit the device into the fuel line. In such instances, or in other such situations, it may be desirable to have the shape of the unit be in the form of a U or V or similarly shaped or configured unit, such as illustrated in FIG. 6. The unit 300 comprise a generally U-shaped non-magnetic hollow tubular housing 312, including a U-shaped central portion 313 of any suitable size, connecting two device portions 315 and 317 of the invention housed therein between inlet aperture 318 and outlet aperture 320.

The features disclosed in the various embodiments may be present in the other embodiments disclosed or other embodiments within the scope and spirit of the invention.

The improved fuel combustion properties obtained with the device of this invention is illustrated by the following Examples 1 to 3. The improved lowering of the temperature of the exhaust gas leaving a combustion chamber is illustrated by Example 4.

EXAMPLE 1

The device of this invention employed in this example was one with an 11½" long 1½" diameter copper tube housing. In the device were alternating layers of aluminum and copper screen materials along the longitudinal axis of the housing, and on each side of the screen material was a row of six ⅜"×⅞"×1⅞" cermet magnets. Overlaying each row of magnets was a carbon steel strip. The test was conducted on a year 2000 Model 1500 Chevrolet Silverado truck (5.3 liter, V8 engine) and emission data recorded with and without the device installed in the fuel line. The results are set forth in the following Table 1 and demonstrate the significant reduction in undesirable emission by-products.

TABLE 1

| Test Condition | Time of Readings | HC ppm | CO % | N0x ppm |
|---|---|---|---|---|
| Without Device | Last 300 seconds of 800 second test | 58 | 0.07 | 17 |
| Total & Average | | 58 | O.07 | 17 |
| With Device | First reading after local driving | 3 | 0 | 10 |
| With Device | After 6 minutes of idle time | 0 | 0 | 9 |
| With Device | After 10 minutes of idle time and with AC on | 0 | 0 | 10 |
| Totals | | 3 | 0 | 29 |
| Average | | 1 | 0 | 9.66 |

EXAMPLE 2

The same device as described in Example 1 was also employed in the fuel line of a 1997 Cadillac DeVille automobile. The significant reduction in harmful emission from the Cadillac DeVille with the device of this invention is demonstrated by the results which are set forth in Table 2.

TABLE 2

| Test Condition | Time of Reading | HC ppm | CO % | N0x ppm |
|---|---|---|---|---|
| With device installed | After 20 mi. trip & short idle time | 0 | 0 | 13 |
| With device installed | After 20 mi. trip & 4 min. idle time | 4 | 0.01 | 13 |
| With device installed | After 20 mi. trip & 24 min idle time | 39 | 0.01 | 14 |
| With device installed | After 20 mi. trip & 27 min. idle time | 44 | 0.01 | 14 |
| With device installed | After local driving & short idle time | 45 | 0.02 | 15 |
| With device installed | After local driving & 4 min. idle time | 2 | 0 | 17 |
| Total | | 151 | 0.05 | 90 |
| Average with device | | 25.16666 | 0.008333 | 15 |
| Without device | Just after taking device off | 100 | 0.03 | 12 |
| Without device | After 6 min. of idle time after taking device off | 132 | 0.11 | 19 |
| Without device | After 50 mi. trip | 106 | 0.05 | 19 |
| Without device | After 50 mi. trip and after 6 min. idle time | 82 | 0.05 | 19 |
| Without device | Shortly after local driving | 294 | 0.37 | 21 |
| Without device | After local driving & 3 min. idle time | 194 | 0.12 | 14 |
| Without device | After local driving & 7 min. idle time | 134 | 0.11 | 18 |
| Totals | | 1042 | 0.84 | 122 |
| Average without device | | 148.8571 | 0.12 | 17.42857 |

EXAMPLE 3

A 1995 Ford Thunderbird with a 4.6 liter V8 gasoline engine was tested with and without a device of this invention. The device had a ½" copper tube housing. A total of ten ⅜"×⅞"×1⅞" cermet magnets were positioned in the device with a first row of five magnets separated from a second parallel row of five magnets, each row separated from one other by alternating layers of aluminum and copper screen material. The emission results for the test were as follows. After 10 minutes of local driving without the device installed, two emissions test readings were taken. The device was then installed on the vehicle, the vehicle driven for 5 miles, and then two emissions test readings were taken. The emissions test data reported are the average values for each of the two sets of readings. The results are set forth in Table 3.

TABLE 3

| Condition | HC ppm | CO % | NOx |
|---|---|---|---|
| Without device | 112.5 | 0.13 | 54.5 |
| With device | 0 | 0.00 | 21.0 |

EXAMPLE 4

The exhaust gas temperatures were measured on the exhaust gases for two commercial fishing and dive boats, with and without a device of this invention installed in the diesel fuel lines of the engines of the boats. One boat was equipped with Caterpillar 3412 engine and the other boat with a Detroit 12V72 engine. The exhaust gas measurements were as follows.

| Engine type | Exhaust Temp. without device | Exhaust Temp. with device |
|---|---|---|
| Caterpillar 3412 | 750° F. | 700° F. |
| Detroit 12V72 | 660° F. | 600° F. |

The use of the device of this invention to treat fuel to be combusted in a combustion chamber, of a truck, automobile, boat, industrial engines, or gas fired boilers and heaters, and the like so the fuel passes through the device just before entering the combustion chamber can produce one or more of the following results: lower fuel consumption, reduction in exhaust gas temperatures, reduction of emissions, clean and keep engines or combustion chambers free of carbon buildup, produce more power per unit of fuel, reduce engine wear and thereby increase engine life, and obtain improved thermal output from fossil fuel. The device of this invention is believed to operate, at least in part, by breaking down hydrocarbon fuel molecule clusters into positively charged individual molecules or sub molecular particles and thereby making the bond to negatively charged oxygen molecules during combustion more complete, thus providing for more complete combustion of the fuel.

With the foregoing description of the invention, those skilled in the art will appreciate that modifications may be made to the invention without departing from the spirit thereof. Therefore, it is not intended that the scope of the invention be limited to the specific embodiments illustrated and described.

I claim:

1. A device for treatment of a hydrocarbon or fossil fuel which is to be combusted in a combustion chamber to improve combustion of the fuel in the combustion chamber by turbulently treating the fuel with a plurality of fields of alternating magnetic flux and subjecting the fuel to a field of differing standard electrochemical reduction potentials, said device being adapted to be connected inline in a fuel supply line of the combustion chamber and comprising:

a non-magnetic, elongate hollow tubular housing having a longitudinal axis, opposing inlet and outlet ends, a generally centrally located inlet aperture in said inlet end for receiving fuel and a generally centrally located outlet aperture in said outlet end for dispensing treated fuel;

a longitudinally extending first plurality of magnets located inside said housing and parallel to a first side of the longitudinal axis, a longitudinally extending second plurality of magnets located inside said housing and parallel to and latitudinally spaced apart from the first set of magnets and located on a second and opposite side of the longitudinal axis, each magnet of said first and second plurality of magnets having a longitudinal pole face facing the longitudinal axis for contact with the fuel to be treated and each having a magnetic polarity, and the magnetic polarity of the longitudinal pole face of each magnet of the first and second plurality of magnets being of alternating polarity with the magnetic polarity of the longitudinal pole of longitudinally adjacent magnets in the respective first and second longitudinal plurality of magnets; and at least two large surface area non-ferrous metal wool or screen materials of differing standard electrochemical reduction potential extending longitudinally along the axis of the housing and between the spaced apart first and second plurality of magnets establishing a field of standard electrochemical reduction potential differential in said housing through which fuel must flow.

2. A device according to claim 1 in which the elongate hollow tubular housing is rectangular in shape.

3. A device according to claim 1 additionally comprising a first elongate longitudinal strip of ferromagnetic material overlaying the first plurality of magnets between the first plurality of magnets and an adjacent wall of the tubular housing, and a second elongate longitudinal strip of carbon steel overlaying the second plurality of magnets between the second plurality of magnets and the adjacent wall of the tubular housing.

4. A device according to claim 1 wherein the large surface area non-ferrous metal wool or screen materials comprises alternating layers of two different metal screens.

5. A device according to claim 4 wherein the alternating layers of two different metal screens comprise alternating layers of copper and aluminum screens.

6. A device according to claim 4 wherein the elongate hollow tubular housing is rectangular in shape and the device additionally comprising a first elongate longitudinal strip of carbon steel overlaying the first plurality of magnets between the first plurality of magnets and an adjacent wall of the tubular housing, and a second elongate longitudinal strip of carbon steel overlaying the second plurality of magnets between the second plurality of magnets and the adjacent wall of the tubular housing.

7. A device according to claim 6 wherein the alternating layers of two different metal screens comprise alternating layers of copper and aluminum screens.

8. A device according to claim 1 wherein the magnetic polarity of the longitudinal pole face of each magnet of the first plurality of magnets is of a magnetic polarity opposite the magnetic polarity of the longitudinal pole face of an opposing facing longitudinal pole face of a magnet of the second plurality of magnets.

9. A device according to claim 8 wherein the first and second plurality of magnets provide a series of alternating fields of magnetic flux along the longitudinal axis providing at least 50 square inches of opposing, facing pole faces of the magnets along the longitudinal axis for contact with the fuel.

10. A device according to claim 1 wherein the first and second plurality of magnets provide a series of alternating fields of magnetic flux along the longitudinal axis providing at least 50 square inches of opposing, facing pole faces of the magnets along the longitudinal axis for contact with the fuel.

11. A device according to claim 10 wherein the device is sized and shaped to provide at least 0.5 seconds of residence time exposure of the fuel to the opposing magnetic pole faces of the magnets providing the series of alternating fields of magnetic flux along the longitudinal axis.

12. A device according to claim 8 wherein the elongate hollow tubular housing is rectangular in shape and the device additionally comprising a first elongate longitudinal strip of ferromagnetic material overlaying the first plurality of magnets between the first plurality of magnets and an adjacent wall of the tubular housing, and a second elongate longitudinal strip of carbon steel overlaying the second plurality of magnets between the second plurality of magnets and the adjacent wall of the tubular housing.

13. A device according to claim 12 wherein the first and second plurality of magnets provide a series of alternating fields of magnetic flux along the longitudinal axis providing at least 50 square inches of opposing, facing pole faces of the magnets long the longitudinal axis for contact with the fuel.

14. A device according to claim 13 wherein the device is sized and shaped to provide at least 0.5 seconds of residence time exposure of the fuel to the opposing magnetic pole faces of the magnets providing the series of alternating fields of magnetic flux along the longitudinal axis.

15. A device according to claim 1 comprising a plurality of axially spaced, radially extending flow controllers, each controller having a central aperture located essentially along the longitudinal axis of the housing for causing fuel flowing through the housing to flow through said central apertures of the flow controllers whereby fuel generally is caused to flow between the facing longitudinal pole faces of the opposing magnets of the first and second plurality of magnets and generally along the longitudinal axis of the housing.

16. A device according to claim 8 comprising a plurality of axially spaced, radially extending flow controllers, each controller having a central aperture located essentially along the longitudinal axis of the housing for causing fuel flowing through the housing to flow through said central apertures of the flow controllers whereby fuel generally is caused to flow between the facing longitudinal pole faces of the opposing magnets of the first and second plurality of magnets and generally along the longitudinal axis of the housing.

17. A device according to claim 1 wherein the magnets comprise magnets having strength of at least about 3800 gauss per magnet.

18. A device according to claim 14 wherein the magnets comprise magnets having strength of at least about 3800 gauss per magnet.

19. A device according to claim 8 wherein each of the first and second plurality of magnets comprise adjacent longitudinally parallel first and second rows of at least five magnets per row, the magnets of the adjacent longitudinally parallel first and second rows of each plurality of magnets being arranged such that the magnetic polarity of the magnetic pole face of each of the magnets along the longitudinal axis in the first row is of opposite polarity from the magnetic polarity of the magnetic pole face of each adjacent magnet along the longitudinal axis in the second row.

20. A device according to claim 12 wherein each of the first and second plurality of magnets comprise adjacent longitudinally parallel first and second rows of at least five magnets per row, the magnets of the adjacent longitudinally parallel first and second rows of each plurality of magnets being arranged such that the magnetic polarity of the magnetic pole face of each of the magnets along the longitudinal axis in the first row is of opposite polarity from the magnetic polarity of the magnetic pole face of each adjacent magnet along the longitudinal axis in the second row.

21. A device according to claim 14 wherein each of the first and second plurality of magnets comprise adjacent longitudinally parallel first and second rows of at least five magnets per row, the magnets of the adjacent longitudinally parallel first and second rows of each plurality of magnets being arranged such that the magnetic polarity of the magnetic pole face of each of the magnets along the longitudinal axis in the first row is of opposite polarity from the magnetic polarity of the magnetic pole face of each adjacent magnet along the longitudinal axis in the second row.

22. A device according to claim 1 additionally comprising a porous bronze filter in the tubular housing adjacent the outlet aperture through which the fuel must flow to exit the device.

23. A device according to claim 7 additionally comprising a porous bronze filter in the tubular housing adjacent the outlet aperture through which the fuel must flow to exit the device.

24. A device according to claim 12 additionally comprising a porous bronze filter in the tubular housing adjacent the outlet aperture through which the fuel must flow to exit the device.

25. A device for treatment of a hydrocarbon or fossil fuel which is to be combusted in a combustion chamber to improve combustion of the fuel in the combustion chamber by turbulently treating the fuel with a plurality of fields of differing magnetic flux and subjecting the fuel to a field of differing standard electrochemical reduction potentials, said device being adapted to be connected in-line in a fuel supply line of the combustion chamber and comprising:

a non-magnetic, elongate hollow tubular housing having a longitudinal axis, opposing inlet and outlet ends, a generally centrally located inlet aperture in said inlet end for receiving fuel and a generally centrally located outlet aperture in said outlet end for dispensing treated fuel;

a plurality of longitudinally elongated magnets located in the housing on opposing sides of the longitudinal axis for contact with the fuel to be treated and providing a series of alternating fields of magnetic flux along the longitudinal; and at least two large surface area non-ferrous metal wool or screen materials of differing standard electrochemical reduction potentials in the housing, the metals being located along the longitudinal axis of the housing and between the magnets of the plurality of magnets and establishing a field of standard electrochemical reduction potential differential in the housing through which the fuel must flow.

26. A device according to claim 25 axis providing at least 50 square inches of opposing, facing pole faces of the magnets for contact with the fuel.

27. A device of claim 25 additionally comprising a plurality of centrally apertured, axially spaced flow control means in the housing which cause fuel to flow centrally through the flow control means, generally along the longitudinal axis, between opposing facing pole faces of the magnets and through the two large surface area non-ferrous metals.

28. The device according to claim 25 wherein the device is sized and shaped to provide at least 0.5 seconds of residence time exposure of the fuel to the opposing magnetic pole faces of the magnets providing the series of differing fields of magnetic flux along the longitudinal axis.

29. The device according to claim 26 wherein the device is sized and shaped to provide at least 0.5 seconds of residence time exposure of the fuel to the opposing magnetic pole faces of the magnets providing the series of differing fields of magnetic flux along the longitudinal axis.

30. A device for treatment of a hydrocarbon or fossil fuel which is to be combusted in a combustion chamber to improve combustion of the fuel in the combustion chamber by turbulently treating the fuel with a plurality of fields of alternating magnetic flux and subjecting the fuel to a field of differing standard electrochemical reduction potentials, said device being adapted to be connected in-line in a fuel supply line of the combustion chamber and comprising:

a non-magnetic, elongate hollow tubular housing having a longitudinal axis, opposing inlet and outlet ends, a generally centrally located inlet aperture in said inlet end for receiving fuel and a generally centrally located outlet aperture in said outlet end for dispensing treated fuel; and a longitudinally extending first plurality of magnets located inside said housing and parallel to a first side of the longitudinal axis, a longitudinally extending second plurality of magnets located Inside said housing and parallel to and latitudinally spaced apart from the first set of magnets and located on a second and opposite side of the longitudinal axis, each magnet of said first and second plurality of magnets having a longitudinal pole face having a magnetic polarity for contact with the fuel to be treated; and the magnetic polarity of the longitudinal pole face of each magnet of the first and second plurality of magnets being of different magnetic polarity to the magnetic polarity of adjacent magnets in the respective first and second longitudinal plurality of magnets.

31. The device of claim 30 wherein the magnetic polarity of the longitudinal pole face of each magnet of the first plurality of magnets is of a magnetic polarity opposite the magnetic polarity of the longitudinal pole face of an opposing facing magnet of the second plurality of magnets.

32. A process for treatment of a hydrocarbon or fossil fuel substantially immediately prior to introducing the fuel into a combustion chamber to improve the combustion of the fuel in the combustion chamber, the process comprising passing said hydrocarbon or fossil fuel into a non-magnetic elongated hollow tubular housing and turbulently passing said fuel:

(a) through a series of differing strong magnetic flux fields created by first and second longitudinal pluralities of spaced-apart opposing magnets within said housing, said magnets being oriented so that longitudinal pole face of each magnet of the first and second pluralities of magnets contact the fuel and is different from the magnetic polarity of the pole faces of adjacent magnets in the respective first and second pluralities of magnets, and (b) into contact with at least two large surface area non-ferrous metal wool or screen materials of differing standard electrochemical reduction potentials located between the first and second pluralities of magnets;

whereby the fuel is subjected to alternating magnetic flux fields, a field of standard electrochemical reduction differential, and mechanical forces.

33. The process of claim 32 wherein opposing longitudinal pole faces of the magnets of the first and second plurality of magnets are of different magnetic polarity.

34. The process of claim 32 wherein (c) the fuel is additionally passed through fuel flow control means requiring generally centralized flow of fuel along a centrally located longitudinal axis of the housing between and in the magnetic flux fields between the opposing longitudinal pole faces of the opposing magnets of the first and second pluralities of magnets.

35. A process for treatment of a hydrocarbon or fossil fuel substantially immediately prior to introducing the fuel into a combustion chamber to break up negatively charged molecule clusters of the fuel and produce positively charged hydrocarbon units to improve combustion of the fuel, the process comprising passing the fuel into a non-magnetic elongated tubular housing having a longitudinal axis, an inlet at a first end, and an outlet at a second and opposite end of the longitudinal axis, and turbulently passing the fuel through the tubular housing in a manner such that the fuel is caused to:

(1) pass through a series of alternating fields of magnetic flux located along the longitudinal axis of the housing such that the fuel is exposed to at least 50 square inches of opposing, facing magnetic pole faces of magnets contacting the fuel and providing said series of alternating fields of magnetic flux; and (2) contact and pass through at least two large surface area non-ferrous metal wool or screen materials of differing standard electrochemical reduction potentials in the housing;

whereby said fuel has at least 0.5 seconds of residence time of exposure to the opposing magnetic pole faces of the magnets providing the series of alternating fields of magnetic flux and the two large surface area non-ferrous metal materials.

36. The process of claim 35 wherein (3) the fuel is additionally caused contact a plurality of centrally aperture spaced flow control means in the housing which cause the fuel to flow centrally through the flow control means and generally along the longitudinal axis and between the opposing magnetic pole faces of the magnets.

* * * * *